US009896258B2

(12) United States Patent
Lee

(10) Patent No.: US 9,896,258 B2
(45) Date of Patent: Feb. 20, 2018

(54) DEVICE HAVING ACCOMMODATION PORTION OPEN VIA MAIN BODY FOR ACCOMMODATING DISSIMILAR MATERIALS

(75) Inventor: Jeong-Min Lee, Seoul (KR)

(73) Assignee: Jeong-Min Lee, Seoul (KR)

( * ) Notice: Subject to any disclaimer, the term of this patent is extended or adjusted under 35 U.S.C. 154(b) by 1240 days.

(21) Appl. No.: 14/412,881

(22) PCT Filed: Dec. 27, 2010

(86) PCT No.: PCT/KR2010/008175

§ 371 (c)(1),
(2), (4) Date: Jan. 5, 2015

(87) PCT Pub. No.: WO2012/060504

PCT Pub. Date: May 10, 2012

(65) Prior Publication Data

US 2015/0175337 A1 Jun. 25, 2015

(30) Foreign Application Priority Data

Nov. 6, 2010 (KR) ..... 10-2010-0110095

(51) Int. Cl.
*B65D 25/08* (2006.01)
*B65D 81/32* (2006.01)
*B65D 51/28* (2006.01)

(52) U.S. Cl.
CPC ..... *B65D 81/3211* (2013.01); *B65D 25/085* (2013.01); *B65D 51/2835* (2013.01);
(Continued)

(58) Field of Classification Search
CPC ..... B65D 51/2828; B65D 51/2835; B65D 51/2864; B65D 51/08; B65D 81/3266
(Continued)

(56) References Cited

U.S. PATENT DOCUMENTS 3,521,745 A * 7/1970 Schwartzman .... B65D 81/3211 206/222
6,003,728 A * 12/1999 Elliott ..... B65D 47/0804 206/219
(Continued)

FOREIGN PATENT DOCUMENTS

JP 2004-238022 A 8/2004
KR 10-2005-0096591 A 10/2005
(Continued)

OTHER PUBLICATIONS

International Search Report dated Nov. 29, 2011.

*Primary Examiner* — Luan K Bui
(74) *Attorney, Agent, or Firm* — Norris McLaughlin & Marcus PA

(57) ABSTRACT

Provided is an accommodating device for accommodating a different type of material and opening an accommodating part via a main body. The accommodating part, which is sealed, is disposed around a container spout part and coupled to the container spout part in a discharge direction of a material contained in the container and includes a storage space having a separate storage function. While the main body is disposed around the container spout part coupled to the accommodating part and is coupled to the container spout part, the storage space disposed in the accommodating part is opened to perform a dropping and mixing process in a storage space disposed in the container.

11 Claims, 10 Drawing Sheets

(52) U.S. Cl.
CPC ..... *B65D 51/2842* (2013.01); *B65D 81/3216* (2013.01); *B65D 51/2828* (2013.01)

(58) Field of Classification Search
USPC ..... 206/219–220, 222, 568; 215/DIG. 8; 53/474
See application file for complete search history.

(56) References Cited

U.S. PATENT DOCUMENTS

| | | | | |
|---|---|---|---|---|
| 7,748,550 | B2 | 7/2010 | Cho | |
| 8,356,711 | B2 * | 1/2013 | Canziani Hoffa | B65D 47/243 206/222 |
| 9,242,772 | B1 * | 1/2016 | Anderson | B65D 47/243 |
| 2002/0040856 | A1 * | 4/2002 | Mollstam | A61J 9/00 206/222 |
| 2006/0108314 | A1 | 5/2006 | Cho | |
| 2007/0045134 | A1 * | 3/2007 | Dvorak | B65D 51/2835 206/222 |
| 2011/0174642 | A1 * | 7/2011 | Coon | B65D 51/2835 206/222 |
| 2011/0284402 | A1 * | 11/2011 | Sharp | B65D 51/224 206/222 |
| 2012/0199503 | A1 * | 8/2012 | Dyrbye | B65D 47/243 206/222 |

FOREIGN PATENT DOCUMENTS

| | | | |
|---|---|---|---|
| KR | 10-2005-0097028 | A | 10/2005 |
| KR | 10 2006-0057310 | A | 5/2006 |

* cited by examiner

[Fig. 1]
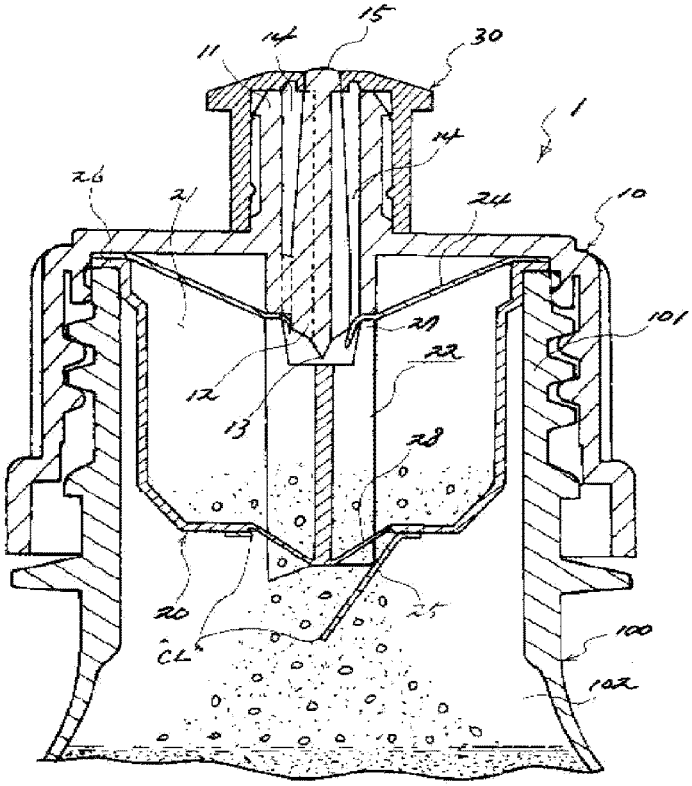
[Fig. 2]
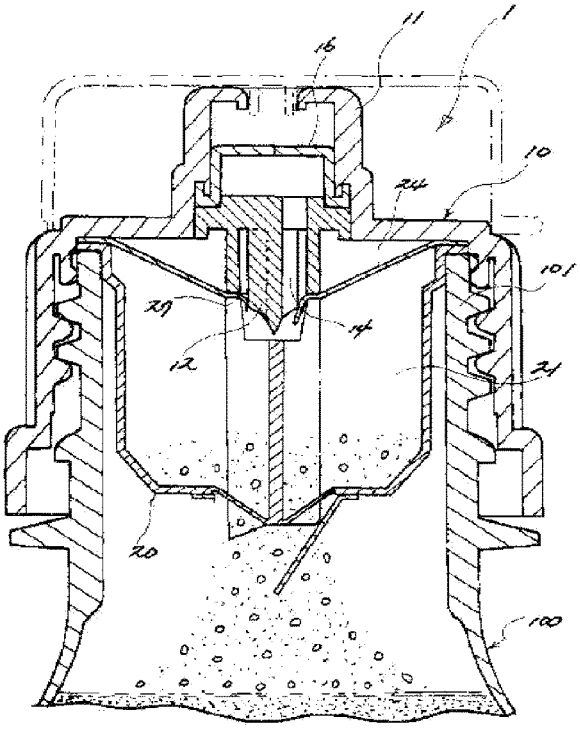

[Fig. 3]
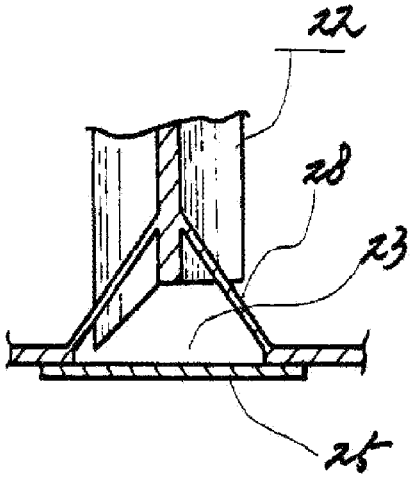
[Fig. 4]
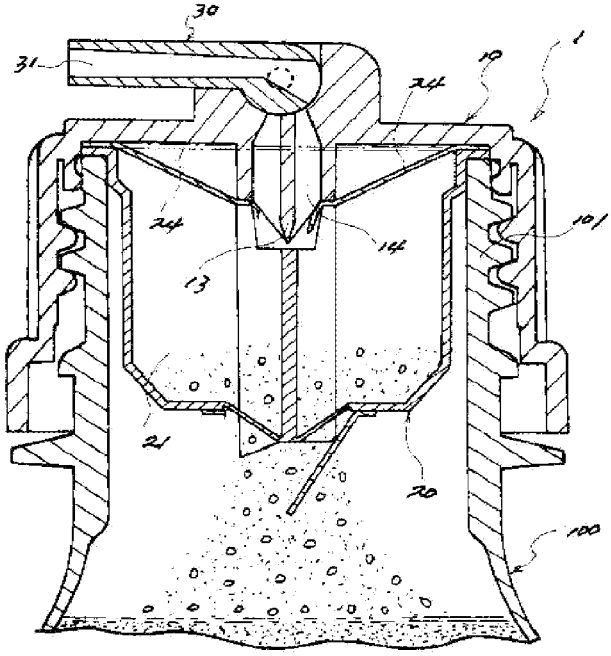

[Fig. 5]
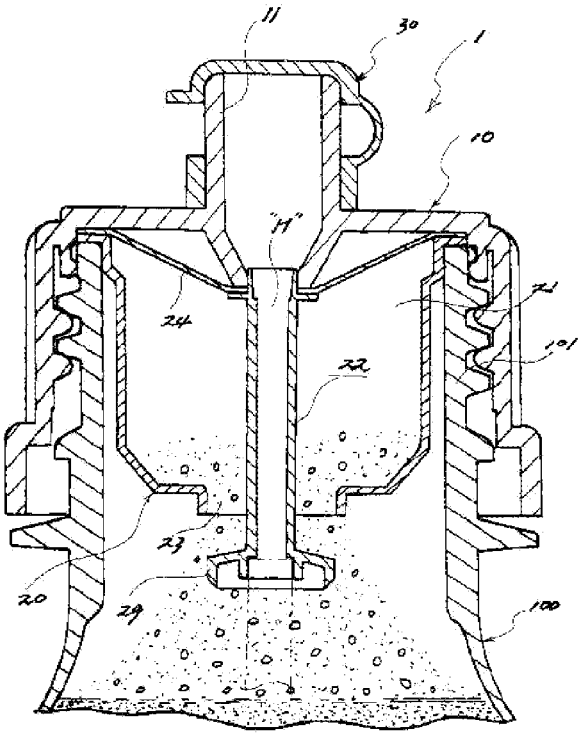
[Fig. 6]
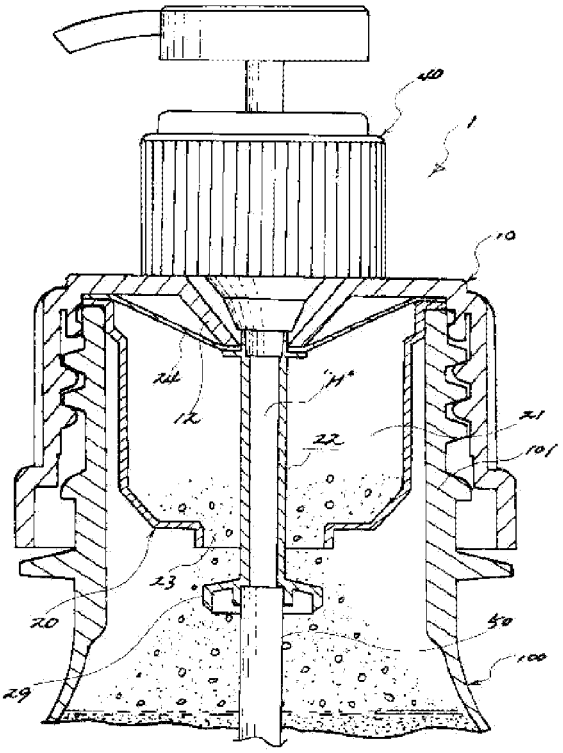

[Fig. 7]
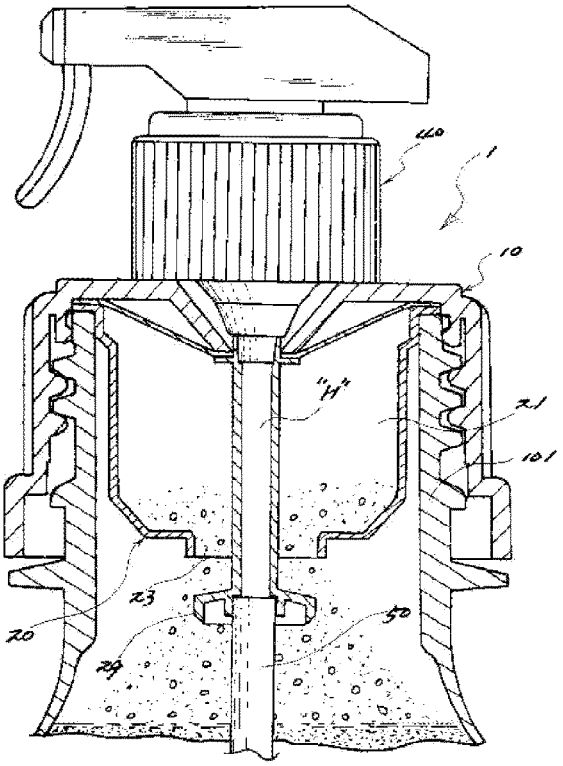
[Fig. 8]
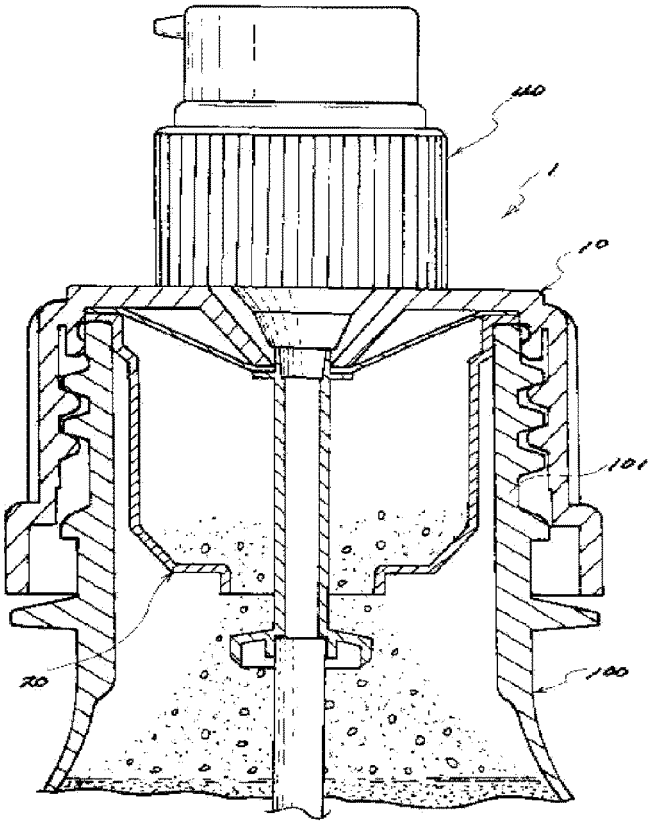

[Fig. 9]
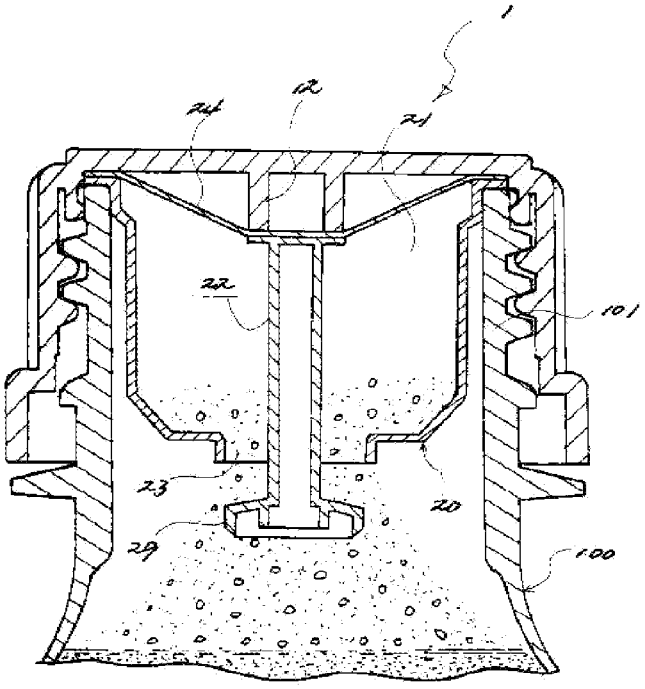
[Fig. 10]
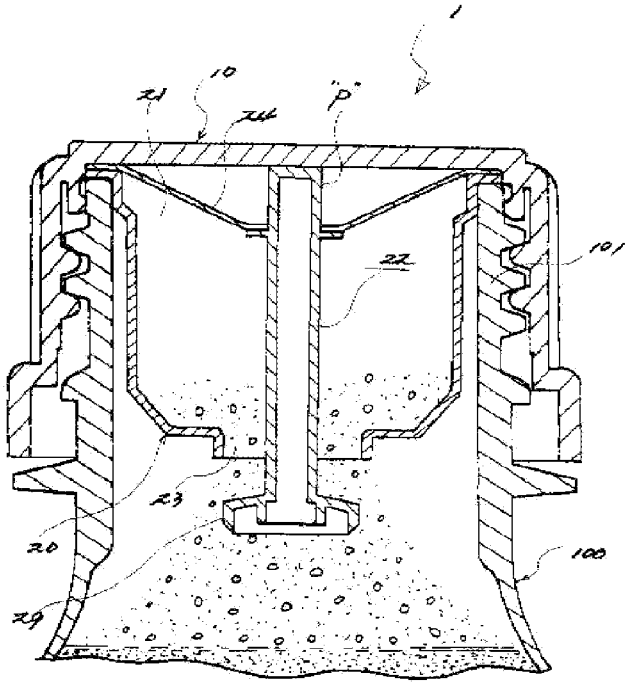

[Fig. 11]
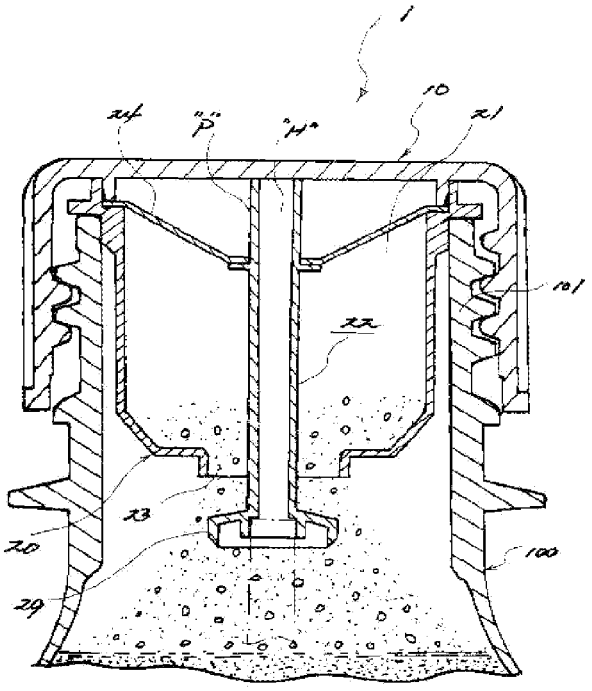
[Fig. 12]
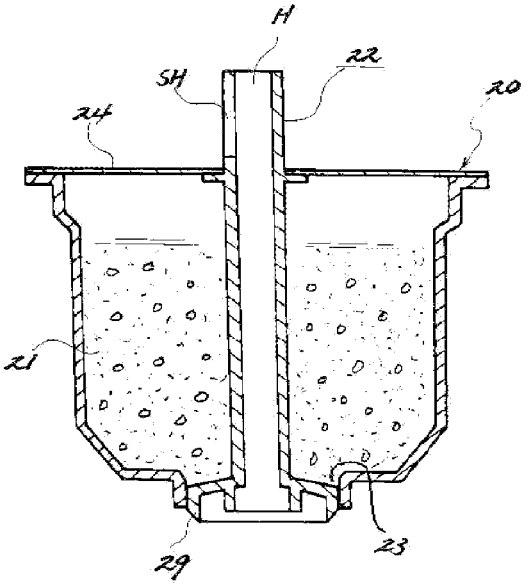

[Fig. 13]
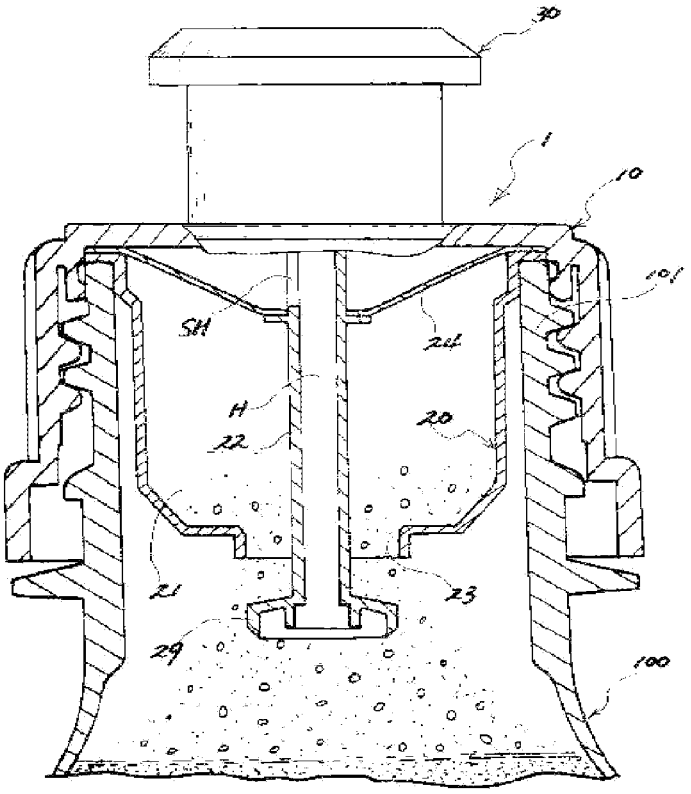
[Fig. 14]
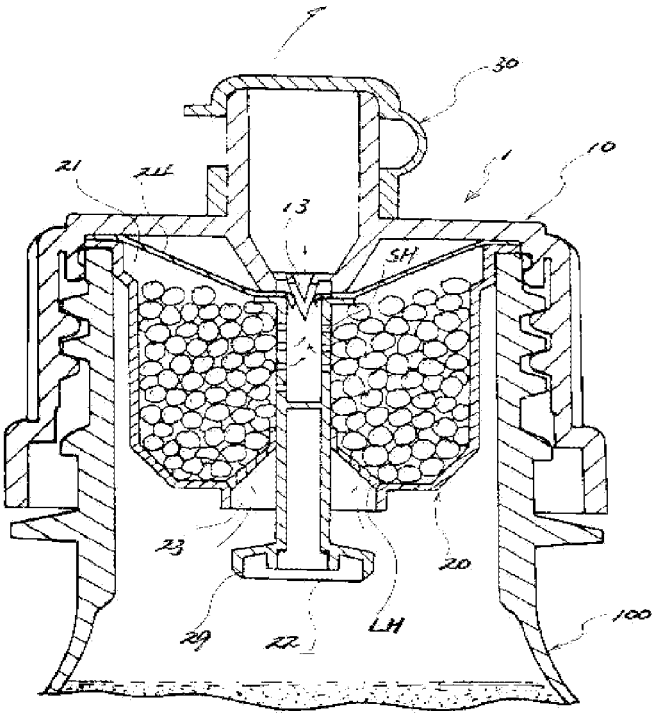

[Fig. 15]
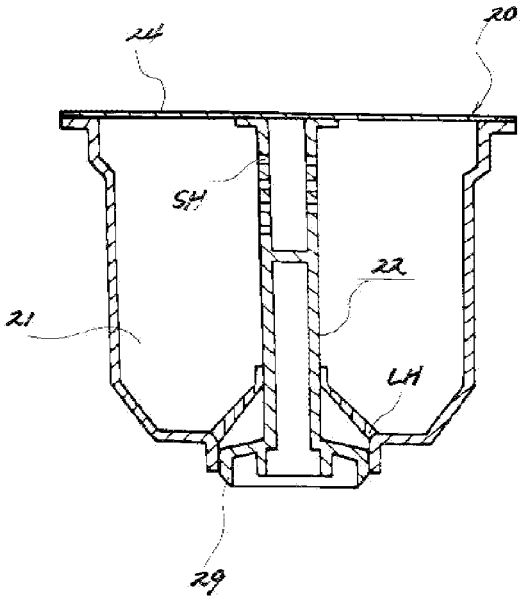
[Fig. 16]
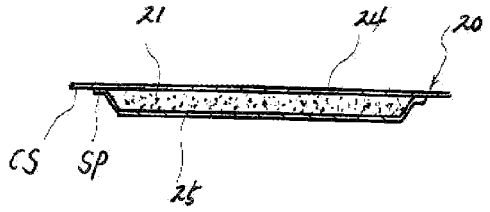
[Fig. 17]
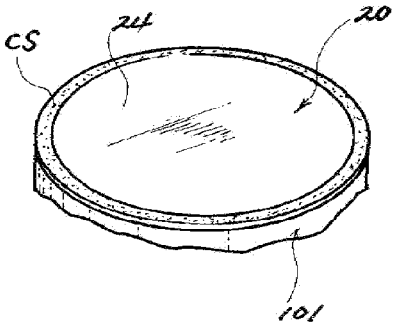

[Fig. 18]
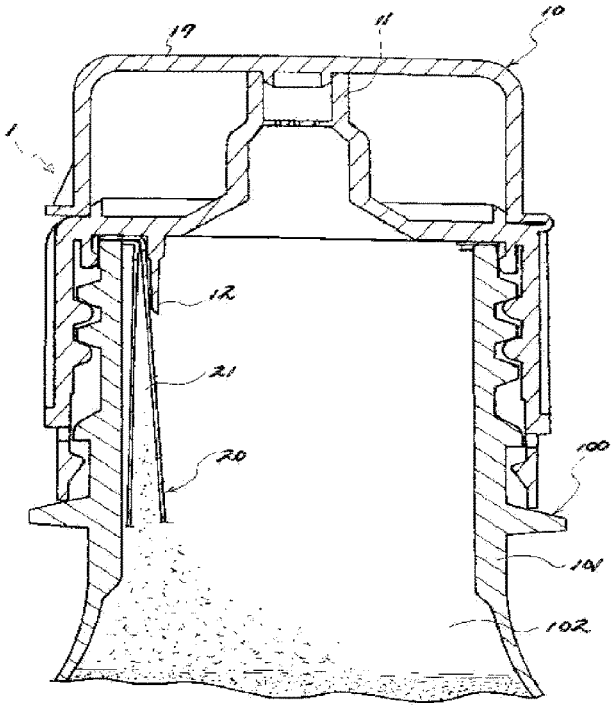
[Fig. 19]
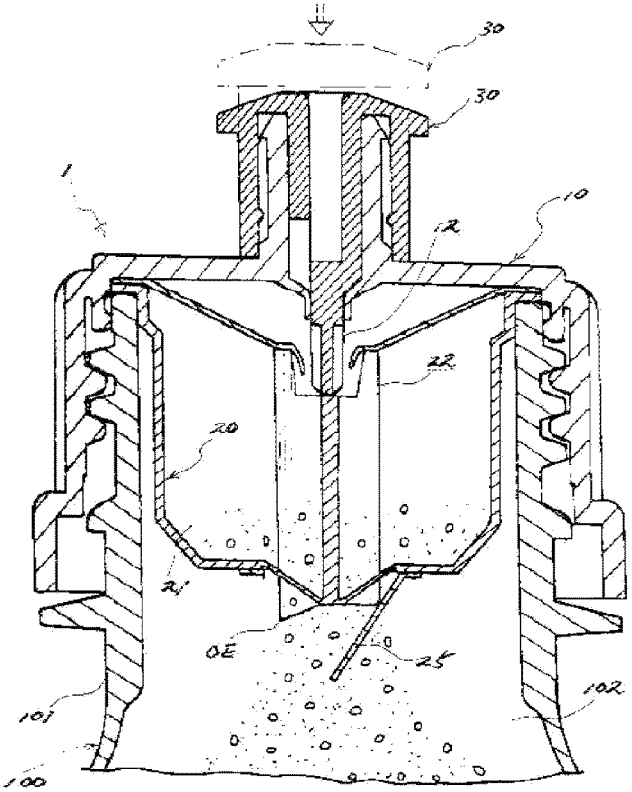

[FIG.20]
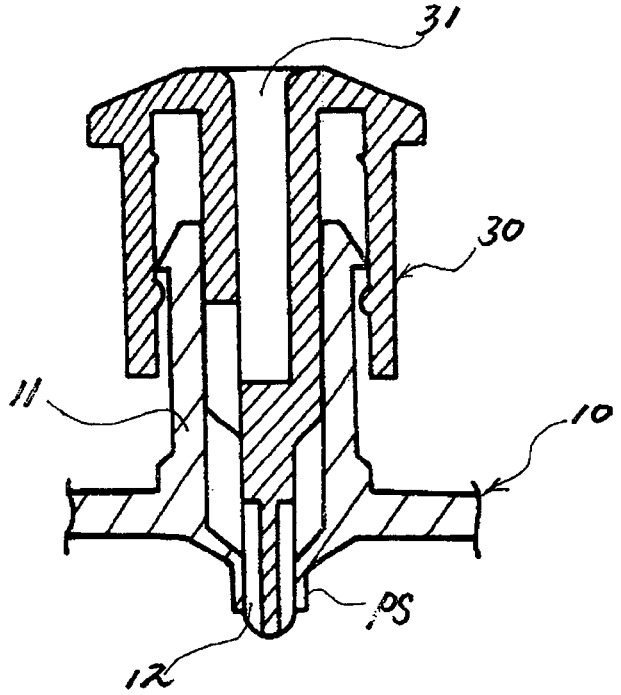
[FIG.21]
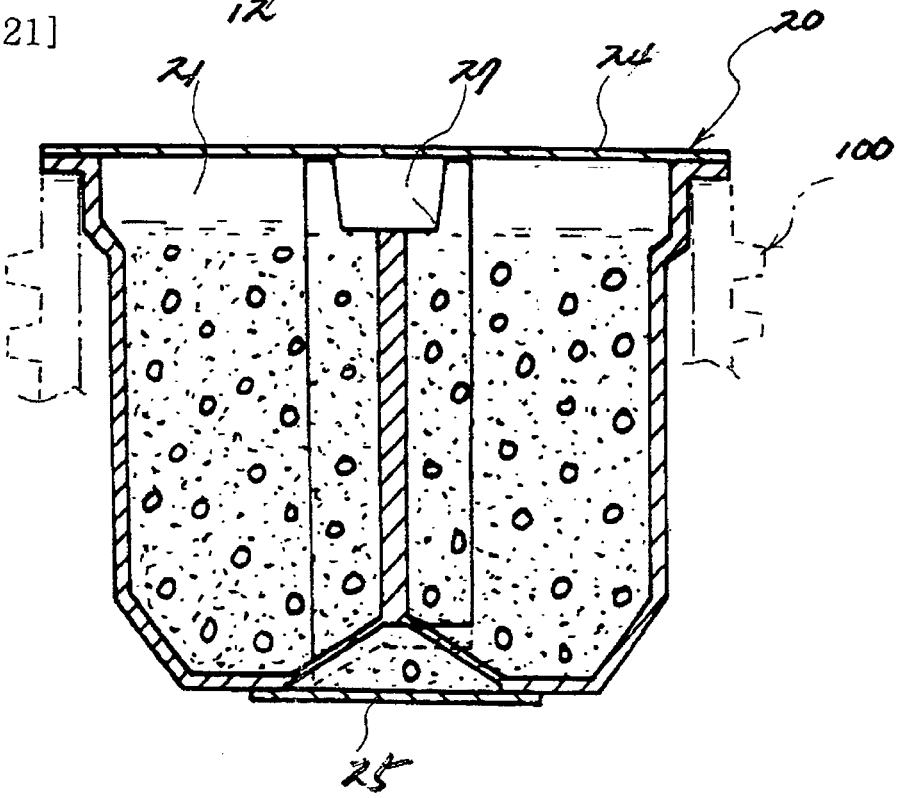

DEVICE HAVING ACCOMMODATION PORTION OPEN VIA MAIN BODY FOR ACCOMMODATING DISSIMILAR MATERIALS

This application is a 371 application of PCT/KR2010/008175 filed Dec. 27, 2010, which claims foreign priority benefit under 35 U.S.C. §119 of Korean application No. 10-2010-0110095, filed Nov. 6, 2010, the disclosure of which is incorporated herein in its entirety.

TECHNICAL FIELD

The present invention relates to an accommodating device for accommodating a different type of material and opening an accommodating part via a main body, which is configured such that while the accommodating part is put in a container spout part, and the main body is joined thereto, the different type of material stored in an inner storage space of the accommodating part automatically falls and undergoes a mixing process, or is configured such that when the accommodating device is coupled, to a container spout part with the accommodating part joined to the container spout part, the accommodating part is opened.

BACKGROUND ART

U.S. Pat. No. 7,032,745 in the related art discloses a technology in which when an accommodating part is joined to a container spout part, and the upper side of the accommodating part is pressed with a hand, a different type of material stored in a storage space disposed in the accommodating part falls into a container and undergoes a mixing process. According to another technology, after a cover of a main body including a discharge member is opened, and a cartridge type accommodating part is put in the main body, when the main body is rotated, a different type of material accommodated in the cartridge type accommodating part falls into a container and undergoes a mixing process.

According to another technology, when a partially removed main body is rotated, a storage space of an accommodating device coupled to a container spoilt part is opened.

DISCLOSURE OF THE INVENTION

Technical Problem

According to the technology disclosed in U.S. Pat. No. 7,032,745 in the related art, the upper side of an accommodating part is pressed with a hand and is thus opened, which is significantly unhygienic. Even when a separate device is provided to press the upper side of the accommodating part, the accommodating part should be removed from the inside of a container spout part in order to drink a mixture contained in a container.

The technology of opening a cover of a main body and joining a cartridge type accommodating part to the main body needs a separate container, and the size of the main body including the cartridge type accommodating part is excessively increased.

To address these issues, according to the present invention, a main body is manufactured to be continually used within a predetermined, period of time, and an accommodating part is consumed in a cartridge manner. When the accommodating part is joined to a container spout part, while the main body is coupled to the container spout part, a storage space of the accommodating part is opened. At this point, a different type of material stored in the storage space falls into a container and undergoes a mixing process.

The accommodating part, accommodating the different type of material, is fixed to the container spout part of the container by using an adhering or coupling method. When the main body as a separate part is operated around the container spout part, the different type of material accommodated in the accommodating part falls into a container storage space and undergoes a mixing process.

Technical Solution

In one embodiment, an accommodating device includes an accommodating part that is disposed around a container spout part and coupled thereto and that has a storage space. As an opening part moves downward, an opening and closing hole of the accommodating part is opened. Upper and lower parts of the storage space disposed in the accommodating part are air-tightly sealed by a sealing part and a sealing part disposed under the accommodating part. The storage space of the accommodating part is opened by a main body disposed around the container spout part and coupled thereto. To this end, an upper part of the accommodating part is pushed downward, and thus, the opening part opens the opening and closing hole disposed under she opening part. To this end, a punching pin and a punching part are disposed on a bottom part of a main body spout pare of the main body. A material stored in the storage space of the accommodating part is discharged out of a container. To this end, a cap is formed above the main body to open and close a discharge hole of the main body spout part of the main body.

The accommodating device may include a main body spout part having a hinge type cover, or a one way check valve in the main body spout part, to discharge a mixture from the container without removing the main, body from the accommodating device.

The accommodating device may include a main body spout part, which is laterally raised or lowered, to discharge a mixture from the container without removing the main body from the accommodating device.

The accommodating device may include a discharge hole as a member for discharging a mixture contained in the container, and the discharge hole is an inner space of the opening part for opening the storage space in an accommodating part. When the main body is disposed around the accommodating part including the opening part and is coupled thereto, a different type of material fails from the storage space of the accommodating part and undergoes a mixing process. The mixture, which is formed through the mixing process, is discharged through both the discharge hole of the opening part and a main body spout part of the main body. The main body spout part an upward penetration member, and the shape thereof is variously changed.

The accommodating device may include a discharge hole as a member for discharging a mixture contained, in the container, and the discharge hole is an inner space of the opening part for opening the storage space in the accommodating part. When the main body is disposed around the accommodating part including the opening part and is coupled thereto, a different type of material fails from the storage space of the accommodating part and undergoes a mixing process. The mixture, which is formed through the mixing process, is discharged through both the discharge hole of the opening part and a main body spout part of the main body. The main body spout part is an upward penetration member, and the shape thereof is variously changed.

Specifically, a mixture is discharged by various pump dispensers connected to a discharge hole.

When, the main body is coupled to the container sport part to discharge the different type of material stored in the storage space of the accommodating part, a punching part formed on a bottom portion of an upper surface part of the main body pushes the sealing part. At this point, the opening and closing hole closing the storage space of the accommodating part is opened.

The accommodating device may be configured such that when the main body is coupled to the container spout part to discharge a material stored in the storage space of the accommodating part, a punching part protruding upward from a sealing part of the accommodating part is moved, downward by a bottom portion of an upper surface part of the main body so as to open an opening and closing hole of the accommodating part.

An accommodating part for accommodating a different type of material may foe disposed, around a container spout part and foe adhered, or coupled to the container spout part in a discharge direction of a material contained in a container. When a main body is disposed around the container spout part provided with the accommodating part and is coupled thereto or touched, the different type of material stored, in a storage space disposed in the accommodating part falls into a container storage space and undergoes a mixing process.

Advantageous Effects

A different type of material stored in a storage space of an accommodating part fails and undergoes a mixing process, without pushing an upper surface part of the accommodating part with a hand, which is hygienic. In addition, a mixture formed, through the mixing process is discharged through a main body spout part disposed at the upper side of a main body.

BRIEF DESCRIPTION OF THE DRAWINGS

FIG. 1 is a vertical cross-sectional view illustrating an accommodating device according to an embodiment of the present invention.

FIG. 2 is a vertical cross-sectional view illustrating an accommodating device according to another embodiment of the present invention.

FIG. 3 is a vertical cross-sectional view illustrating a principal part of an opening part according to the present invention.

FIGS. 4 to 11 are vertical cross-sectional views illustrating an accommodating device according to other embodiments of the present invention.

FIG. 12 is a vertical cross-sectional view illustrating an accommodating part according to another embodiment of the present invention, and FIG. 13 is a vertical cross-sectional view illustrating a state in which while a main body is disposed around a container spout part and coupled thereto, a storage space of the accommodating part is opened.

FIG. 14 is a vertical cross-sectional view illustrating a material as solid granules stored in a storage space of an accommodating part, and a configuration in which when a main body is disposed around the accommodating part and coupled thereto, an opening part of the accommodating part is opened downward, according to another embodiment of the present invention, and FIG. 15 is a vertical cross-sectional view illustrating the accommodating part and the storage space without the material.

FIG. 16 is a vertical cross-sectional view illustrating a structure of an accommodating part manufactured using a soft film method or a pneumatic vacuum method, according to another embodiment of the present invention, FIG. 17 is a perspective view illustrating a principal part of the accommodating part that can be coupled to a container spout part by using a method such as a heat adhesion method, an ultrasonic method, or a high frequency method, and FIG. 18 is a vertical cross-sectional view illustrating a configuration in which when, a main body is disposed around the container spout part provided with the accommodating part and is coupled thereto, a punching part of the main body breaks the accommodating part to drop a material stored in a storage space into a container.

FIG. 19 is a vertical cross-sectional view illustrating an accommodating part adhered or coupled to a container spout part, and a configuration in which when a main body as a separate part is disposed around the container spout, part provided with the accommodating part and is coupled thereto or pressed, a punching part formed, on the main body and having a variously changeable shape opens a storage space of the accommodating part, according to another embodiment of the present invention, FIG. 20 is a vertical cross-sectional view illustrating a cap part for a principal part of the main body, and FIG. 21 is a vertical cross-sectional view illustrating the accommodating part.

BEST MODE FOR CARRYING OUT THE INVENTION

An accommodating device 1 according to the present invention includes an accommodating part 20 that is disposed around, a container spout part 101 and coupled thereto and that has a storage space 21. As an opening part 22 moves downward, an opening and closing hole 23 of the accommodating part 20 is opened. Upper and lower parts of the storage space 21 disposed in the accommodating part 20 are air-tightly sealed by a sealing part 24 and a sealing part 25 disposed under the accommodating part 20. The storage space 21 of the accommodating part 20 is opened by a main body 10 disposed around, the container spout part 101 and coupled thereto. To this end, an upper part of the accommodating part 20 is pushed downward, and thus, the opening part 22 opens the opening and closing hole 23 disposed under the opening part 22. To this end, a punching pin 13 and a punching part 12 are disposed on a bottom part of a main body spout part 11 of the main body 10. A material stored in the storage space 21 of the accommodating part 20 is discharged out of a container 100. To this end, a cap 30 is formed above the main body 10 to open and close a discharge hole of the main body spout part 11 of the main body 10.

Referring to FIG. 1, in a state that an upper hoop 26 of the accommodating part 20 is disposed on an upper end of the container spout part 101, when the main body 10 is coupled to the accommodating device 1, the punching pin 13 breaks the sealing part 24, and simultaneously, the punching part 12 pushes an upper end part 2 of the opening part 22. At this point, a foldable part 28 is folded downward, and simultaneously, an end part of the opening part 22 breaks the sealing part 25 closing the opening and closing hole 23. At this point, the material stored in the storage space 21, which is a different type of material, fails through the opening and closing hole 23 in a container storage space 103 disposed in the container 100 and undergoes a mixing process.

When the cap 30 joined to the main body spout part 11 is raised, a discharge hole plug 15 closing a discharge hole 14 is opened to discharge a mixture formed through the mixing process in the container storage space 103.

Referring to FIG. 2, an accommodating device 1 includes a main body spout part 11 having a hinge type cover, or a one way check valve 16 in the main body spout part 11, to discharge a mixture from, a container 100 without removing a main body 10 from the accommodating device 1.

Referring to FIG. 4, an accommodating device 1 includes a cap 30 having a cap discharge hole 31, which is laterally raised or lowered on a main body spout part 11, to discharge a mixture from a container 100 without removing a main body 10 from the accommodating device 1.

Referring to FIG. 5, an accommodating device 1 includes a discharge hole H as a member for discharging a mixture contained in a container 100, and the discharge hole H is an inner space of an opening part 22 for opening a storage space 21 in an accommodating part 20. When a main body 10 is disposed around the accommodating part 20 including the opening part 22 and is coupled thereto, a different type of material fails from the storage space 21 of the accommodating part 20 and undergoes a mixing process. The mixture, which is formed through the mixing process, is discharged through both the discharge hole H of the opening part 22 and a main body spout part 11 of the main body 10. The main body spout part 11 is an upward penetration member, and the shape thereof is variously changed.

Referring to FIG. 6, an accommodating device 1 includes a discharge hole H as a member for discharging a mixture contained in a container 100, and the discharge hole H is an inner space of an opening part 22 for opening a storage space 21 in an accommodating part 20. When a main body 10 is disposed around the accommodating part 20 including the opening part 22 and is coupled thereto, a different, type of material falls from the storage space 21 of the accommodating part 20 and undergoes a mixing process. The mixture, which is formed through the mixing process, is discharged through both the discharge hole H of the opening part 22 and a main body spout part 11 of the main body 10. The main body spout part 11 is an upward penetration member, and the shape thereof is variously changed. Specifically, a mixture is discharged by various pump dispensers 40 (refer to FIGS. 7 and 8) connected to a discharge hole H.

When the main body 10 is coupled to a container spout part 101 to discharge the different type of material stored in the storage space 21 of an accommodating part 20, a punching part 12 formed on a bottom portion of an upper surface part of the main body 10 pushes the sealing part 24. At this point, an opening and closing hole sealing part 29 closing the storage space 21 of the accommodating part 20 moves out of an opening and closing hole 23.

Referring to FIG. 9, an accommodating device 1 is configured, such that when a main body 10 is coupled to a container spout part 101 to discharge a material stored in a storage space 21 of an accommodating part 20, a punching part 12 protruding from a bottom portion, of an upper surface part of the main body 10 pushes a sealing part 24 of the accommodating part 20 downward so as to open an opening and closing hole 23 of the accommodating part 20.

Referring to FIG. 10, an accommodating device 1 is configured such that when a main body 10 is coupled to a container spout part 101 to discharge a material stored in a storage space 21 of an accommodating part 20, a punching part P protruding upward from a sealing part 24 of the accommodating part 20 is moved downward by a bottom portion of an upper surface part of the main body 10 so as to open an opening and closing hole 23 of the accommodating part 20.

Referring to FIG. 11, an accommodating device 1 is configured such that a storage space 21 of an accommodating part 20 is opened even by a typical cap (a main body 10). For reference, an opening part 22 can be variously modified as illustrated in FIG. 3.

To sum up, an accommodating part 20 has a storage space 21 that stores a different type of material such as a liquid or powder, and an upper part of the accommodating part 20 is sealed by a sealing part 24. The sealing part (surface) 24 of the accommodating part 20 is partially punched, or is pushed downward into the accommodating part 20 by a punching part 12 of a main body 10 as a separately assembled part, and simultaneously, an opening part 22 is moved downward to open an opening and closing hole 23 in a bottom portion of the accommodating part 20, or a sealing part 25 under the accommodating part 20. The different type of material stored in the storage space 21 of the accommodating part 20 fails in a container storage space 102 through the opening and closing hole 23 or an open space of the sealing part 25 and undergoes a minting process.

The accommodating part 20 is opened via the main body 10 and is configured, such that when the main body 10 is disposed around the accommodating part 20 and coupled thereto, an upper end part of the opening part 22 extending from the inside of the accommodating part 20 is pushed downward by a bottom portion of an upper surface part of the main body 10 to open the sealing part (surface) 25 or the opening and closing hole 23 closing the storage space 21 of the accommodating part 20.

Such a structure is illustrated in FIGS. 12 and 13, in which an upper end part of an opening part 22 protrudes to the upper side of a sealing part 24, and an accommodating part 20 is disposed around a container spout part 101 and coupled thereto. When a main body 10 is disposed around the container spout part 101 and coupled thereto, a protruding portion of the opening part 22 is pushed downward, by a bottom portion of an upper surface part of the main body 10 to open an opening and closing hole sealing part 29 closing an opening and closing hole 23.

At this point (referring to FIG. 13), a material stored in a storage space 21 falls into a container 100 through the opening and closing hole 23, and simultaneously, the sealing part 24 is stretched downward with a small amount of elasticity. When a cap 30 is raised and the container 100 is inclined to a side to discharge a mixture including the material, the mixture is passed through the opening and closing hole 23 and a side discharge hole SH of the opening part 22 and is discharged via the cap 30 disposed above the opening and closing hole 23 and the side discharge hole SH.

According to another embodiment (refer to FIGS. 14 and 15), a storage space 21 of an accommodating part 20 stores solid crystals such as granules dissolved by a liquid, and the storage space 21 of the accommodating part 20 is air-tightly sealed by an opening part 22 closing an opening and closing hole 23 of the accommodating part 20. When a main body 10 is disposed around the accommodating part 20 and coupled thereto, the opening part 22 is opened downward by a push type punching part or a punching pin 13 of the main body 10. In this state, when the container 100 is opened to a side thereof, the liquid contained, in the container 100 moves to the storage space 21 through both the opening and closing hole 23 opened by a downward movement of the opening part 22 and one or more lower holes LH of the accommodating part 20, and dissolves a material stored in the storage space 21. At this point, the dissolved material is discharged through, a side discharge hole SH formed on the upper side of the opening part 22.

In other words, referring to FIGS. 14 and 15, solid granules are stored in the storage space 21 of the accommodating part 20, and the one or more lower holes LH are disposed in the opening and closing hole 23 at the lower end of the storage space 21. In addition, the opening and closing hole 23 is air-tightly sealed by the opening and closing hole sealing part 29 of the opening part 22.

In addition, the side discharge hole SH is formed in an upper side surface part of the opening part 22 and is isolated from the opening and closing hole sealing part 29, and a sealing part 24 is formed above the opening part 22.

According to another embodiment (refer to FIGS. 16 to 13), an accommodating part 20 for accommodating a different type of material is disposed around a container spout part 101 and is adhered or coupled to the container spout part 101 in a discharge direction of a material contained in a container 100. When a main body 10 is disposed around the container spout part 101 provided with the accommodating part 20 and is coupled thereto or touched, the different type of material stored in a storage space 21 disposed in the accommodating part 20 falls into a container storage space 102 and undergoes a mixing process.

In particular, the storage space 21 formed in the accommodating part 20 stores a different type of material such as a liquid or powder and is sealed. When the main body 10 having a cap form is disposed around the container spout part 101 provided with the accommodating part 20 and is coupled, thereto or pressed, at least one portion of the accommodating part 20 is opened by a punching part 12 formed on the main body 10 having a cap form, and simultaneously, the different type of material stored, in the storage space 21 disposed in the accommodating part 20 fails into the container storage space 102 and undergoes the mixing process.

A sealing part 25 having a shape corresponding to that of the storage space 21 is formed under the accommodating part 20. A sealing part 24 is disposed above the sealing part 25 to seal the storage space 21. The accommodating part 20 is disposed around an upper end part, of the container spout part 101 and is adhered or coupled thereto.

The sealing parts 24 and 25 of the accommodating part 20 are provided in a soft film form. A portion of the accommodating part 20 between the sealing parts 24 and 25 is air-tightly sealed by a sealing part adhering part SP. A container adhering part CS of the accommodating part 20 is formed, on an upper end of the container spout part 101 by using a method such as a heat adhesion method, an ultrasonic method, or a high frequency method.

A cover part 17 is raised to discharge a mixture through a main body spout part 11.

One or more containers 100 provided with the accommodating part 20 are hygienically packaged using a separate vinyl packaging method. A portion of the packaged containers 100 may include an accommodating device 1 as the main body 10 to open the accommodating part 20 of the container 100.

For example, the number of the containers 100 provided with, the accommodating part 20 may be about 11, and the containers 100 may be hygienically packaged in a vinyl packaging form, a box packaging form, or a fixable packaging form. The packaged containers 100 may include one or two main bodies 10.

When a customer, bought such a packaged system, disposes the main body 10 around the upper part of the container 100 and couples the main body 10 thereto, the punching part 12 of the main body 10 breaks the accommodating part 20, so that a material stored in the storage space 21 falls into the container 100. Thus, the customer can immediately drink a fresh mixture such as vitamins.

In addition, one main body 10 can be washed and used to open a plurality of accommodating parts 20, thereby reducing waste pollution.

According to another embodiment (refer to FIGS. 19 to 21), an accommodating part 20 having a storage space 21 is assembled on a container spout part 101 of a container 100 or is coupled or adhered thereto. The accommodating part 20 is configured such that the storage space 21 is opened while a main body 10 is coupled to the container 100, or a sealing part 24 as an upper surface of the accommodating part 20 is pressed or touched.

When an opening part 22 disposed in the storage space 21 is moved downward, a lower end part OE of the opening part 22 opens a sealing part 25 disposed under the accommodating part 20, to form an opening and closing hole. While the main body 10 as a separate part is coupled to the container 100, a punching part 12 pushes an upper end part 27 of the opening part 22, and simultaneously, the opening and closing hole is formed.

At this point, the punching part 12 punches a portion of the sealing part 24, and a mixture is discharged to a cap discharge hole 31 through a gap formed by raising a cap 30 disposed around a main body spout part 11 and coupled thereto.

When the cap 30 is closed, the cap 30 is moved downward to close a punching part sealing surface PS, thereby sealing the residue of the mixture.

For reference, when the accommodating part 20 is formed on an upper end of the container spout part 101, the main body 10 capable of opening the accommodating part 20 is disposed around the container spout pare 101 and coupled, thereto while the main body 10 is maintained in a state before opening the accommodating part 20. Then, when the main body 10 is coupled to the container spout part 101 or pressed in a screw manner by using, e.g., a method of removing a safety device installed, on a portion of the main body 10, a punching pin or the punching part 12 of the main, body 10, or the opening part 22 of the accommodating part 20 is pushed downward to open the storage space 21 of the accommodating part 20.

Alternatively, the accommodating part 20 may be formed as a sealing thin plate having a simple shape to seal the container spout part 101, and a sealed portion of the container spout part 101 may be broken while the main body 10 opening the accommodating part 20 and including a separate punching part is coupled to the container spout part 101.

INDUSTRIAL APPLICABILITY

A bottle cap according to the present invention is significantly useful, to a field of separately storing a contained material and performing a mixing process thereon (such as a field related to beverages or alcohol), and to a different type of material accommodating device used to protect the environment or reduce waste.

The invention claimed is:

1. An system for mixing dissimilar materials, said system comprising components (A) and (B):

(A) a main body, (B) an accommodating part comprising (1) a storage space therein for storing a first material, which storage space is sealed, (2) an opening part running vertically through the storage space, (3) an upper opening sealed by a first sealing part, and (4) a lower opening sealed by a second sealing part located below the opening part, or form a bottom portion of the opening part, wherein, (i) components (A) and (B) are separated or separable, (ii) components (A) and (B) are configured such that, upon coupling component (A) to a container spout part of a container which has already been adhered to or coupled to component (B), such that component (A) is disposed around the container spout part, and component (B) is disposed on or around the container spout part, component (A) causes breakage or deformation of the first sealing part, thereby causing a downward movement of the opening part, thereby causing breakage, deformation or movement of the second sealing part such that the lower opening is no longer sealed, thereby allowing the first material to fall through the lower opening to mix with a second material dissimilar from the first material, which second material is contained in the container.

2. The system of claim 1, wherein the first material is a liquid or a powder.

3. The system of claim 1, wherein the first material is a solid crystal, and the second material is a liquid, and the first material is dissolvable by the second material.

4. The system of claim 1, wherein component (A) comprises a punching part protruding downward therefrom, which causes breakage or deformation of the first sealing part upon coupling component (A) to the container spout part which has already been adhered to or coupled to component (B).

5. The system of claim 1, wherein component (A) comprises a main body spout part comprising a discharge hole, configured such that a mixture of the first and the second material can be discharged from the container without removal of component (A).

6. The system of claim 5, wherein component (A) further comprises a cap configured to open and close the discharge hole of the main body spout part.

7. The system of claim 1, wherein the opening part of component (B) comprises a discharge hole which is an inner space of the opening part.

8. The system of claim 1, wherein the first sealing part, or the second sealing part, or both the first and the second sealing part, are in the form of a soft film.

9. A package comprising the system of claim 1, comprising two or more units of component (B).

10. An method for mixing dissimilar materials using the system according to claim 1, said method consisting essentially of steps (1) and (2) in order:

(1) providing a container comprising a container spout part having been adhered to or coupled to component (B) such that component (B) is disposed on or around the container spout part, wherein the storage space of component (B) comprises the first material, and the container contains the second material, and the first material and the second material are not in contact with each other, and (2) coupling component (A) to the container spout part such that it is disposed around the container spout part, thereby causing the first material to travel through the lower opening of component (B) into the container, thereby mixing with the second material.

11. An assembly for mixing dissimilar materials, comprising the system according to claim 1, and a container comprising the container spout part.

* * * * *